US009844231B2

(12) United States Patent
Barber et al.

(10) Patent No.: US 9,844,231 B2
(45) Date of Patent: Dec. 19, 2017

(54) METHOD AND APPARATUS FOR IMPARTING AN ORGANOLEPTIC QUALITY TO A RECIPIENT PRODUCT

(75) Inventors: Louis Barber, London (GB); Andrew McLellan, London (GB); Richard Hepworth, London (GB); Mark Cassell, London (GB); Robert Whiffen, London (GB); Aaron Brookbank, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/005,064

(22) PCT Filed: Mar. 6, 2012

(86) PCT No.: PCT/EP2012/053819
§ 371 (c)(1),
(2), (4) Date: Oct. 16, 2013

(87) PCT Pub. No.: WO2012/123289
PCT Pub. Date: Sep. 20, 2012

(65) Prior Publication Data

US 2014/0026907 A1 Jan. 30, 2014

(30) Foreign Application Priority Data

Mar. 15, 2011 (GB) ..... 1104311.4

(51) Int. Cl.
*A24B 3/12* (2006.01)
*A24B 15/30* (2006.01)
(Continued)

(52) U.S. Cl.
CPC ..... *A24B 15/303* (2013.01); *A24B 3/12* (2013.01); *A24B 13/00* (2013.01); *A24B 15/186* (2013.01); *A24D 3/048* (2013.01)

(58) Field of Classification Search
CPC ..... A24B 3/12; A24B 13/00; A24B 15/303; A24B 15/186; A24D 3/048
(Continued)

(56) References Cited

U.S. PATENT DOCUMENTS 248,481 A 10/1881 Lawrence
1,450,377 A * 4/1923 Lunt ..... 34/468
(Continued)

FOREIGN PATENT DOCUMENTS

CN 101608145 A 12/2009
EP 1120049 A1 8/2001
(Continued)

OTHER PUBLICATIONS

International Search Report and Written Opinion, dated Jun. 5, 2012, for International Application No. PCT/EP2012/053819, filed Mar. 6, 2012.
(Continued)

*Primary Examiner* — Michael J Felton
*Assistant Examiner* — Yana B Krinker
(74) *Attorney, Agent, or Firm* — Cantor Colburn LLP

(57) ABSTRACT

An apparatus for imparting an organoleptic quality to a recipient product using a sensate substance obtained from a donor product, the apparatus comprising a donor product storage chamber; and a recipient product storage chamber, the apparatus being arranged to allow a fluid to circulate repeatedly between the donor product storage chamber and the recipient product storage chamber so that at least one sensate substance obtained from the donor product is conveyed from the donor product storage chamber into the
(Continued)

recipient product storage chamber and into contact with the recipient product.

22 Claims, 5 Drawing Sheets

(51) Int. Cl.
*A24B 15/18* (2006.01)
*A24D 3/04* (2006.01)
*A24B 13/00* (2006.01)

(58) Field of Classification Search
USPC ..... 131/302; 126/374, 348, 343.5; 34/10, 34/36, 37, 57
See application file for complete search history.

(56) References Cited

U.S. PATENT DOCUMENTS

| | | | | |
|---|---|---|---|---|
| 1,631,052 | A * | 5/1927 | Oertel | 34/472 |
| 2,229,943 | A * | 1/1941 | Touton | 131/302 |
| 2,933,823 | A * | 4/1960 | Cramer et al. | 34/552 |
| 3,548,838 | A | 12/1970 | Key et al. | |
| 3,678,939 | A | 7/1972 | Key, III et al. | |
| 3,800,806 | A | 4/1974 | Banks | |
| 3,858,546 | A | 1/1975 | Benson et al. | |
| 3,991,771 | A | 11/1976 | Banks | |
| 4,054,145 | A | 10/1977 | Berndt et al. | |
| 4,150,677 | A | 4/1979 | Osborne, Jr. et al. | |
| 4,182,915 | A * | 1/1980 | Harvey | C07C 17/093 525/343 |
| 4,438,775 | A | 3/1984 | Mays et al. | |
| 4,530,165 | A * | 7/1985 | Tiedemann | 34/406 |
| 4,791,909 | A | 12/1988 | Kalthoff | |
| 5,103,842 | A | 4/1992 | Strang et al. | |
| 5,399,688 | A * | 3/1995 | Sipos et al. | 544/275 |
| 5,445,714 | A * | 8/1995 | Myers | 202/176 |
| 5,711,320 | A | 1/1998 | Martin | |
| 5,865,890 | A | 2/1999 | Makujina | |
| 6,048,404 | A | 4/2000 | White | |
| 6,150,498 | A * | 11/2000 | Abel et al. | 528/388 |
| 6,718,988 | B1 | 4/2004 | Cooper et al. | |
| 6,868,777 | B1 | 3/2005 | Higgins et al. | |
| 2005/0199223 | A1 * | 9/2005 | von Andrian-Werburg et al. | 123/520 |
| 2012/0328749 | A1 | 12/2012 | Forsythe et al. | |
| 2016/0073682 | A1 | 3/2016 | Barber et al. | |

FOREIGN PATENT DOCUMENTS

| | | | |
|---|---|---|---|
| EP | 1815899 | A1 | 8/2007 |
| JP | 09-188614 | A | 7/1997 |
| JP | 2009-005620 | A | 1/2009 |

OTHER PUBLICATIONS

Written Opinion, dated Feb. 11, 2013, for International Application No. PCT/EP2012/053819, filed Mar. 6, 2012.
International Preliminary Report on Patentability, dated May 21, 2013, for International Application No. PCT/EP2012/053819, filed Mar. 6, 2012.
First Examination Report issued by New Zealand Intellectual Property Office dated Apr. 8, 2014 for IP No. 614475.
European Office Action for European Patent Application No. 12707108.2-1656; dated Apr. 6, 2017; 4 pages.

* cited by examiner

METHOD AND APPARATUS FOR IMPARTING AN ORGANOLEPTIC QUALITY TO A RECIPIENT PRODUCT

CLAIM FOR PRIORITY

This application is a National Stage Entry entitled to and hereby claiming priority under 35 U.S.C. §§365 and 371 to corresponding PCT Application No. PCT/EP2012/053819, filed Mar. 6, 2012, which in turn claims priority to GB Application No. 1104311.4, filed Mar. 15, 2011. The entire contents of the aforementioned applications are herein expressly incorporated by reference.

FIELD

The invention relates to the field of imparting an organoleptic quality to a recipient product, particularly but not exclusively a tobacco industry product.

BACKGROUND

Where permitted by local regulations, a tobacco industry product may be provided with additives which modify certain of its organoleptic or sensory qualities. Cigarettes, cigars, snus, chewing tobacco and the like may be provided with additives in order to provide a modified taste and aroma profile. Examples of suitable additives include menthol, coffee, juniper, elderflower, star anise as well as many others.

Hitherto, such additives have been included into tobacco industry products during their manufacture. For example, additives may be added to tobacco rods during the manufacture of smoking articles. Also, additives may be applied to a wrapper circumscribing a tobacco rod. In this case the additive may included in an adhesive used in the manufacturing process. In both of these approaches a certain amount of contact between tobacco product and the additive is required.

SUMMARY

Embodiments of the invention described in more detail hereinafter by way of example provide an apparatus for imparting an organoleptic quality to a recipient product using a sensate substance obtained from a donor product, in which the apparatus comprises a donor product storage chamber, and a recipient product storage chamber, the apparatus being arranged to circulate a fluid repeatedly between the donor product storage chamber and the recipient product storage chamber so that at least one sensate substance obtained from the donor product is conveyed from the donor product storage chamber into the recipient product storage chamber and into contact with the recipient product.

In one embodiment, the donor product can be a botanical and the recipient product can be a tobacco industry product. The botanical may be heated to a temperature within a range of 10° C.-150° C. to release its sensate. For example the donor product may include mint heated to up to 90° C., or coffee and heated up to 40° C., or clove and heated up to 110° C.

The botanical may be provided in a frozen state, which is ground into a particulate form prior to circulating the fluid.

The temperature of the botanical may be varied over time and for example the botanical may be heated to a first temperature for a first period of time to release a first sensate with a first relatively low boiling point, and then the temperature of the botanical is raised to a second, higher temperature to release a second sensate with a higher boiling point than the first sensate.

The tobacco industry product may be one of: tobacco, snus, pouched snus, filter paper, tipping paper, filtration material, smoking articles, smoking article containers or blanks for forming smoking article containers.

In one embodiment, the fluid entering the donor product storage chamber is pre-heated to contribute to the release of the sensate from the donor product.

BRIEF DESCRIPTION OF THE DRAWINGS

In order that the invention may be more fully understood embodiments thereof will now be described by way of illustrative example with reference to the accompanying drawings in which.

DETAILED DESCRIPTION

As used herein the term recipient product means a product to which an organoleptic quality is imparted. In embodiments described hereinafter, the recipient product is a product used in the tobacco industry. Such tobacco industry products should be understood to include end products, such as snus when pouched or loose, smoking article filters, entire smoking articles or smoking article containers as well as intermediate products such as tobacco, filtration material, blanks for forming smoking article containers and so forth. Using blanks rather than fully formed smoking article containers has the advantage of conserving space.

Where the recipient product is tobacco, various varieties of tobacco may be used as well as tobacco in various stages of processing. For example, cut rag tobacco, tobacco in whole leaf form or laminar, stem, reconstituted tobacco shettor papers or ground tobacco may be used. In embodiments of the present invention where the recipient product is tobacco, tobacco rods may be formed for use in smoking articles in a manner known per se in the art and then imparted with an organoleptic quality.

As used herein, the term donor product means a product that is used to impart an organoleptic quality to the recipient product. In embodiments described hereinafter, donor products include botanicals such as mint, juniper, anise, star anise and clove although others could be used.

Figure 1:
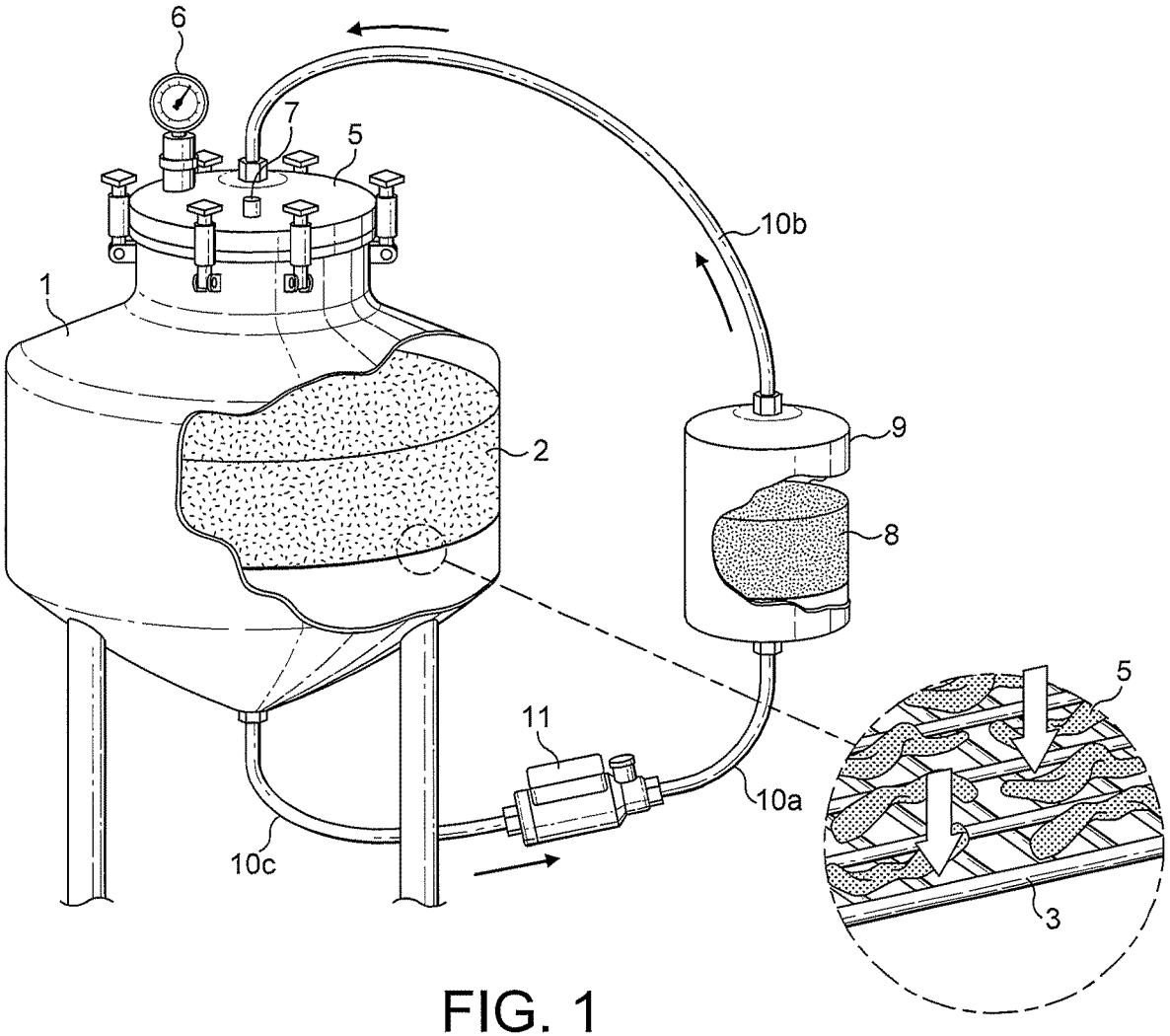
FIG. 1 is a part exploded three dimensional view of an apparatus according to an embodiment of the present invention.

An embodiment of an apparatus for imparting an organoleptic quality to a recipient product is illustrated in FIG. 1 in which the donor product comprises a botanical and the recipient product comprises a tobacco industry product, which in this example is tobacco. The apparatus shown in FIG. 1 comprises a recipient product storage chamber 1 in which a tobacco industry product 2 is received. In this example the product is shredded tobacco leaf but other recipient products may be used as discussed previously. A mesh shelf 3 may be located inside the chamber 1 to support the tobacco industry product 2. The storage chamber 1 has a sealable lid 5 that can be opened to allow the recipient product to be stored in and removed from the chamber. A pressure gauge 6 and a safety valve 7 may also be provided.

In the embodiment shown in FIG. 1, a donor botanical 8 is stored in a donor storage vessel 9. The botanical 8 can be stored in the botanical storage vessel 8 as a solid, for example in leaf or berry form or as ground leaf or berry according to a particular mesh size discussed in more detail hereinafter. Alternatively, the botanical 10 may be stored in the form of a gaseous extract or as a pressurised liquid which may be accompanied by a suitable propellant. In the latter case where the botanical 8 is in gaseous or pressurised liquid form the botanical storage vessel 50 may be modified to accommodate gaseous or liquid contents in a way that would be apparent to those skilled in the art.

A fluid, in this example air, is repeatedly recirculated through the donor and recipient chambers 1,9, through a conduit arrangement comprising tubing 10 by a pump 11. The tubing 10 comprises three tubing portions 10*a*, 10*b*, 10*c* and may be constructed from any suitable material which does not itself elute significant contaminants into the fluid flow. A suitable material is stainless steel but certain plastics tubing can also be used. The first portion 10*a* extends between the pump 11 and the donor product storage vessel 9. The second portion 10*b* extends between the donor product storage vessel 9 and the recipient product storage vessel 1. The third portion 10*c* extends from the recipient product storage vessel 1 to the pump 11. Air may be pumped by the pump 11 in the direction shown by the arrows in FIG. 1, although in an alternative arrangement it can be pumped in the opposite direction.

In use, the air is pumped by pump 11 through the first portion boa of the tubing into the donor product storage chamber 9 and sensate components of the botanical 8 in the chamber 8 are conveyed in the air stream through the second portion of tubing 10*b* into the recipient product storage chamber 1. Inside the chamber 1 the air conveying sensate constituents of the botanical 8 travels through the tobacco industry product 2 stored in the chamber 1 so that the tobacco industry product 2 becomes impregnated with sensate constituents of the botanical 8. Air leaves the chamber 1 through the third portion of tubing 10*c* to be recirculated by the pump 11 through the tubing 10 for a given amount of time, and when the tobacco industry product is sufficiently impregnated with the sensate, the product can be removed from the chamber by temporary removal of the lid 5.

Figure 2:
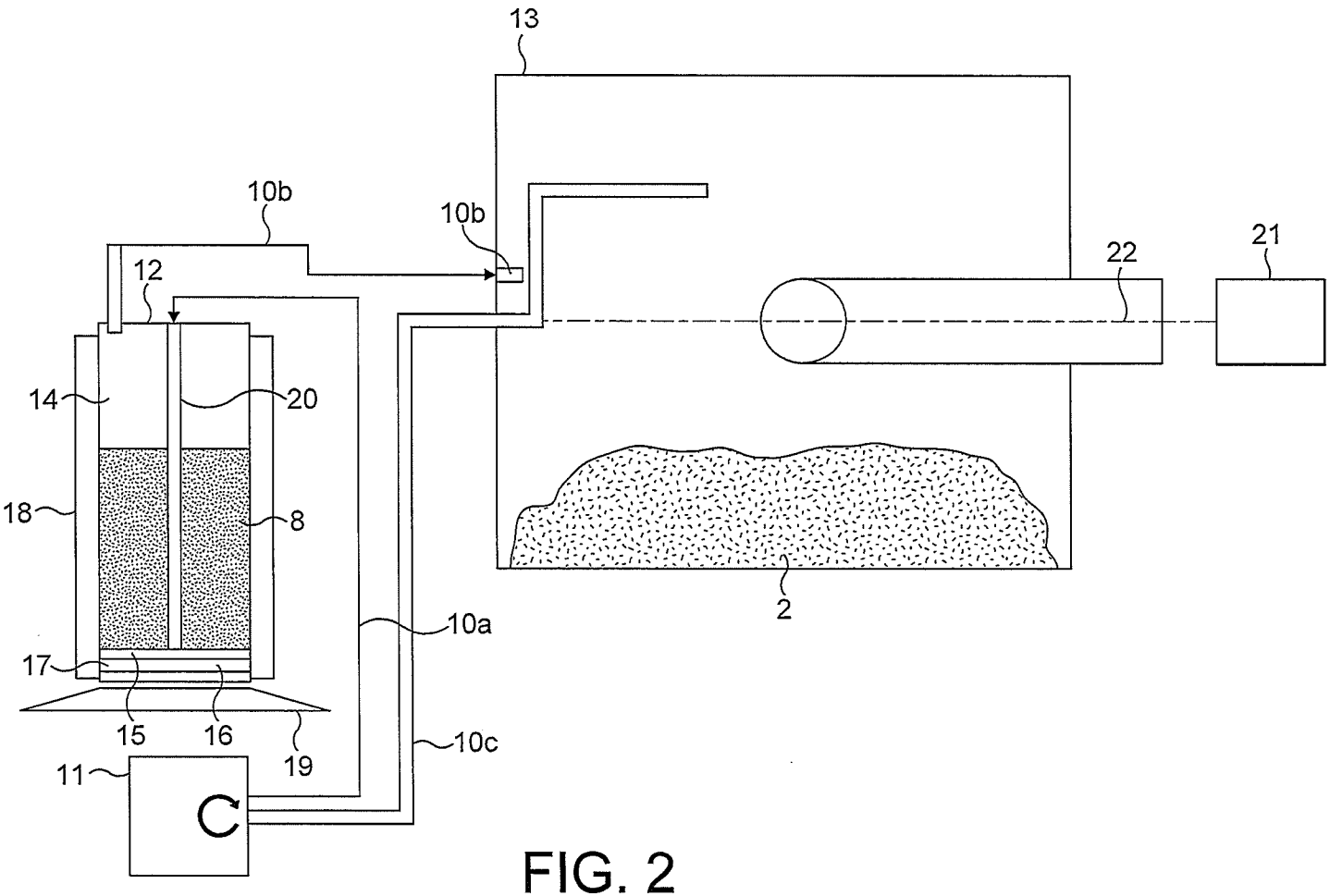
FIG. 2 is a side view of apparatus according to another embodiment of the present invention.

FIG. 2 shows an alternative arrangement comprising a donor product storage chamber in the form of a botanical storage vessel 12, a recipient product storage chamber in the form of a tobacco mixing drum 13 and a pump 11. A fluid comprising air in this example is pumped in a closed loop through a conduit comprising an air pipe 10*a* into the botanical storage vessel 12 by the pump 11. A pipe 10*b* extends between the storage vessel 12 and the mixing drum 13 and a further pipe 10*c* extends between the mixing drum 13 and the pump 11. The pump 11 could comprise a peristaltic pump; alternative types of pump that could be used include amongst others, a vane pump, centrifugal compressor, piston pump, gear pump and liquid ring pump. The apparatus shown in FIG. 2 can be operated at atmospheric pressure.

The storage vessel 12 has an internal chamber 14 to hold botanical products 8 such as juniper, coffee, star anise or any other suitable botanical product. The botanical product 8 is supported on a wire mesh 15 located in the lower portion 16 of the chamber 14. Water 17 is stored in the portion of the chamber 16 below the wire mesh 15. However it may not always be necessary to use water in the process depending upon the moisture level of the botanical product 8. The sides of the vessel 12 are wrapped by a heat jacket 18 and a heat mat 19 is placed under the vessel 12. The heat jacket 18 and heat mat 19 are configured to apply heat to the contents of the chamber 12 and can be driven in any suitable way. For example the heat jacket and mat can be electrically heated and/or steam heated. The pipe 10*a* which connects the peristaltic pump 11 to the storage vessel 12, enters the vessel 12 from above. Air pumped into the vessel 12 passes through an internal pipe 20 located inside the vessel 12 to the bottom so that the flow thereafter passes upwardly through the botanical 8 to receive sensates to be transferred to the recipient tobacco product in drum 13.

The tobacco mixing drum 13 is arranged to hold a quantity of tobacco industry product 5 to be infused or impregnated with sensate constituents from the botanical products 8 stored in the storage vessel 12. The mixing drum 13 may be configured such that it can be rotated by a motor 21 about its central axis 22. Rotating the mixing drum 13 facilitates the infusion of the tobacco industry product 2 with sensate constituents of the botanical product 8.

In use, air is pumped by the peristaltic pump 11 into the storage vessel 12. The air is fed to the lower portion of the internal chamber 14 through the internal pipe 20 and passes through the water 17 stored in the part of the chamber 14 below the wire mesh 15 which supports the botanical product 8. Preferably, the heat jacket 18 and heat mat 19 heat the storage vessel to approximately 90° C. The applied heat and the air flow act to evaporate a substantial proportion of the water stored in the storage vessel 12 creating water vapour. The air and water vapour are forced upwards through the wire mesh 15 and through the botanical product 8. The heat applied to the botanical storage vessel 12 is conducted and radiated into the botanical product 8 which is stored within. This energy causes some of the sensate material contained within the botanical product 8 to vapourise into the gas phase contained within the vessel. As the air and water vapour pass through the storage vessel 12, they entrain the sensate vapours and create a mixture which hereon is referred to as process air. The process air is then forced out of the vessel 12 through the pipe 10*b* that connects the vessel 12 with the mixing drum 13 which contains a quantity of tobacco industry product 2 to be infused with the sensate vapours of the botanical product 8.

The mixing drum 13 is at a lower temperature than the storage vessel 12 and so the process air conveyed into the drum 13 from the storage vessel 12 through the pipe 10*b*, the sensate vapours begin to condense in the drum 13.

Rotation of the drum 13 about a cylindrical axis 22 by motor 21 allows a thorough circulation of the tobacco industry product 5 and condensed sensate constituents within the drum 13. In this way the tobacco industry product 2 becomes infused with sensate constituents from the botanical product 10. The process described above can be continued until all the water stored in the storage chamber 60 has been evaporated. Alternatively, the process may be run for a set period of time to enact a desired level of infusion into the tobacco industry product 2.

Figure 3:
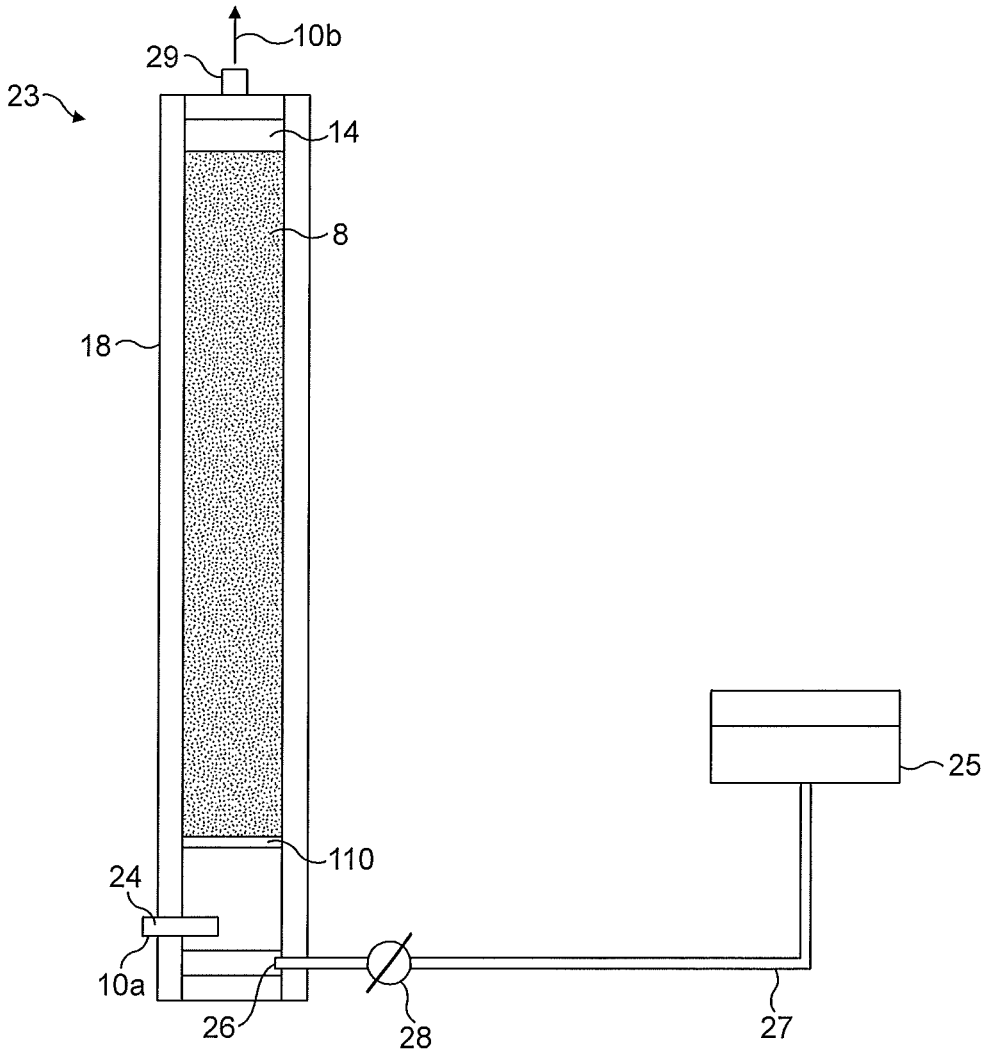
FIG. 3 is a side view of another storage vessel that can be used in the apparatus of FIG. 2.

An alternative donor product storage chamber is shown in FIG. 3, comprising storage vessel 23. The vessel 23 is elongate and extends upwardly, with air from the pump 11 entering the vessel from an inlet 24 located towards the bottom of the vessel 23. Water is stored in a water storage chamber 25 and fed into the vessel 23 through a water inlet 26 through conduit 27 controlled by a valve 28. As in the vessel 12 shown in FIG. 2, the vessel 23 shown in FIG. 3 is heated by a heat jacket 18. Water is evaporated by the air flow and the applied heat from the heat jacket 18. The water vapour is conveyed upwards through the botanical product 8 stored in the chamber 14 and supported on the wire mesh 15. The process air containing sensate vapour leaves the vessel 23 via an air outlet 29 and is conveyed through pipe 10*b* towards a mixing drum 13 as shown in FIG. 2, where the condensation of the sensate vapour and infusion of the tobacco industry product 5 stored therein take place.

EXPERIMENTAL DATA

Experiments were performed to analyse the effects of different infusion conditions when infusing tobacco with juniper using the apparatus described above with reference to FIGS. 2 and 3. Five samples were investigated using Solid Phase Microextraction-Gas Chromatography/Mass Spectrometry (SPME-GC/MS) analysis of aromatic constituents deposited onto the tobacco during the infusion process.

TABLE 1

Figure 4:
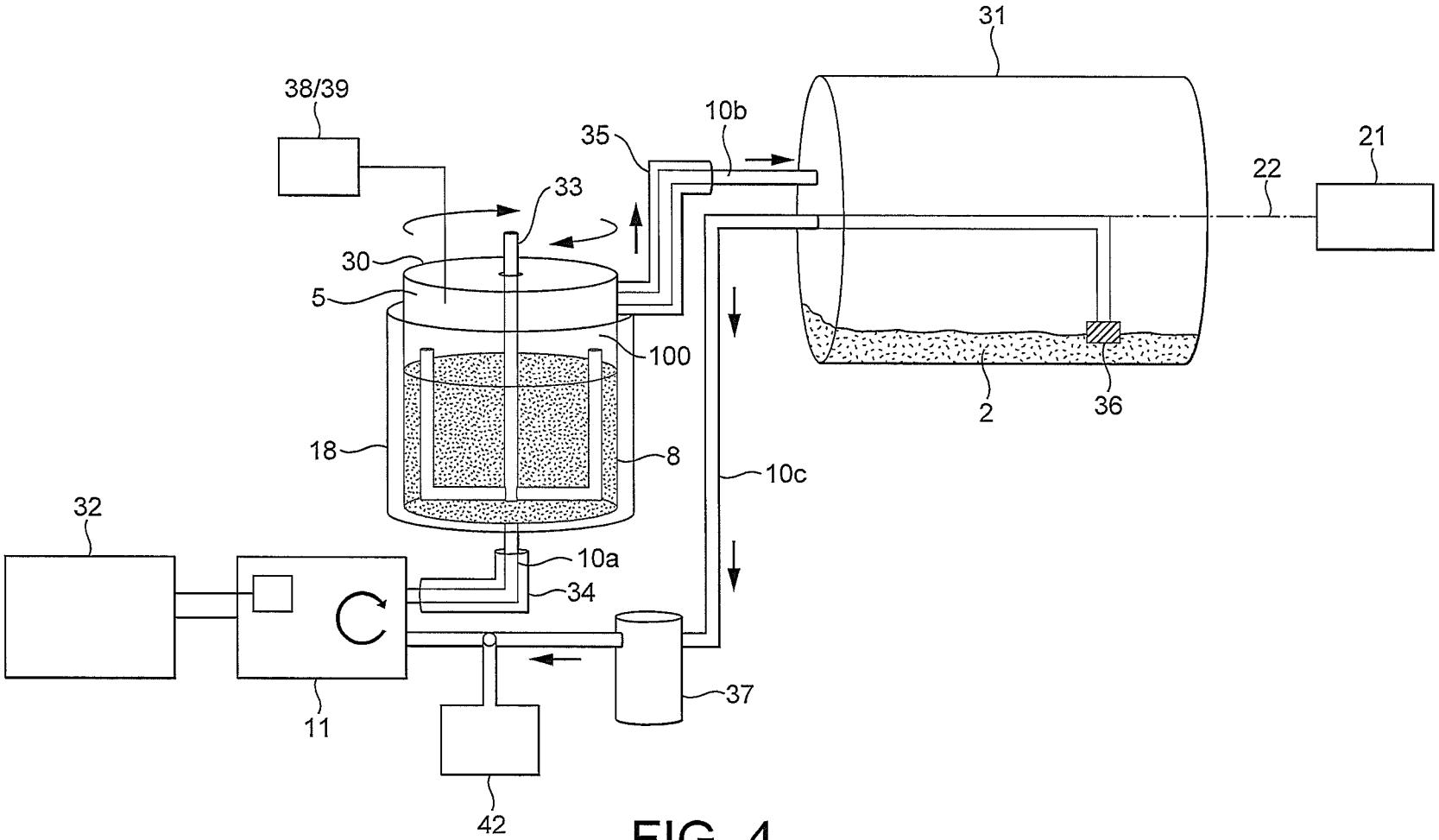
FIG. 4 is a side view of an embodiment of apparatus for imparting an organoleptic quality to a recipient product.

| Sample | Description of sample |
|---|---|
| Juniper 1 | 2 kg juniper berry milled from frozen, heated to 90° C. using the apparatus shown in FIG. 4 with 10 kg tobacco |
| Juniper 2 | 2 kg juniper berry milled from frozen heated to 90° C. using the apparatus shown in FIG. 3 with 10 kg tobacco |
| Juniper 3 | The tobacco which had been impregnated in Juniper 1 was impregnated by an additional 2 kg juniper berry milled from frozen heated to 90° C. using the apparatus shown in FIG. 4. |
| Juniper 4 | The tobacco which had been impregnated in Juniper 2 was impregnated by an additional 2 kg juniper berry milled from frozen heated to 90° C. using the apparatus shown in FIG. 4. |
| Juniper control sample | Ground juniper berry - no tobacco. |
| Tobacco control sample | Tobacco only - no juniper. |

The results of the analysis are shown in Table 2. The amount of a particular constituent present in each sample is expressed as a mean of two replicates of the sample except for the juniper control sample where only one replicate was analysed.

| Sample | Tobacco control (μg) | Juniper 1 (μg) | Juniper 2 (μg) | Juniper 3 (μg) | Juniper 4 (μg) | Juniper control (μg) |
|---|---|---|---|---|---|---|
| Camphene | 0.00 | 0.07 | 0.09 | 0.11 | 0.38 | 3.42 |
| Phellandrene | 0.00 | 0.20 | 0.21 | 0.30 | 0.91 | 8.42 |
| Terpinene | 0.00 | 0.55 | 0.56 | 0.75 | 1.59 | 7.25 |
| Terpinolene | 0.00 | 0.80 | 0.88 | 1.06 | 3.52 | 13.02 |
| Linalool | 0.00 | 0.02 | 0.02 | 0.04 | 0.06 | 0.14 |
| Sabinene hydrate | 0.00 | 0.04 | 0.03 | 0.07 | 0.08 | 0.33 |
| Carvo-menthol | 0.01 | 0.33 | 0.32 | 0.67 | 0.68 | 1.35 |
| Terpineol | 0.00 | 0.04 | 0.03 | 0.08 | 0.09 | 0.65 |
| Citronellol | 0.00 | 0.00 | 0.00 | 0.00 | 0.00 | 0.08 |
| Bornyl acetate | 0.00 | 0.17 | 0.16 | 0.30 | 0.43 | 2.86 |
| Citronellyl butyrate | 0.00 | 0.00 | 0.00 | 0.00 | 0.00 | 0.17 |
| Cubebene | 0.01 | 0.13 | 0.12 | 0.25 | 0.59 | 2.29 |
| Longipinene | 0.00 | 0.01 | 0.01 | 0.02 | 0.05 | 0.27 |
| Ylangene | 0.00 | 0.01 | 0.01 | 0.02 | 0.05 | 0.49 |

-continued

| Sample | Tobacco control (μg) | Juniper 1 (μg) | Juniper 2 (μg) | Juniper 3 (μg) | Juniper 4 (μg) | Juniper control (μg) |
|---|---|---|---|---|---|---|
| Elemene | 0.01 | 0.11 | 0.11 | 0.19 | 0.35 | 2.47 |
| Cubebene | 0.00 | 0.02 | 0.02 | 0.03 | 0.06 | 0.96 |
| Isoledene | 0.00 | 0.01 | 0.01 | 0.02 | 0.23 | 2.77 |
| Amorphene | 0.00 | 0.15 | 0.13 | 0.25 | 0.48 | 6.28 |
| Cadinene | 0.00 | 0.16 | 0.12 | 0.26 | 0.47 | 7.44 |
| Selinadiene | 0.00 | 0.01 | 0.01 | 0.02 | 0.03 | 1.03 |
| Longifolene | 0.00 | 0.00 | 0.00 | 0.00 | 0.00 | 0.20 |

As can be seen from Table 2 constituents present in the juniper control sample and absent from the tobacco control sample are present in the samples Juniper 1-4 prepared in accordance with the present invention.

Figure 5:
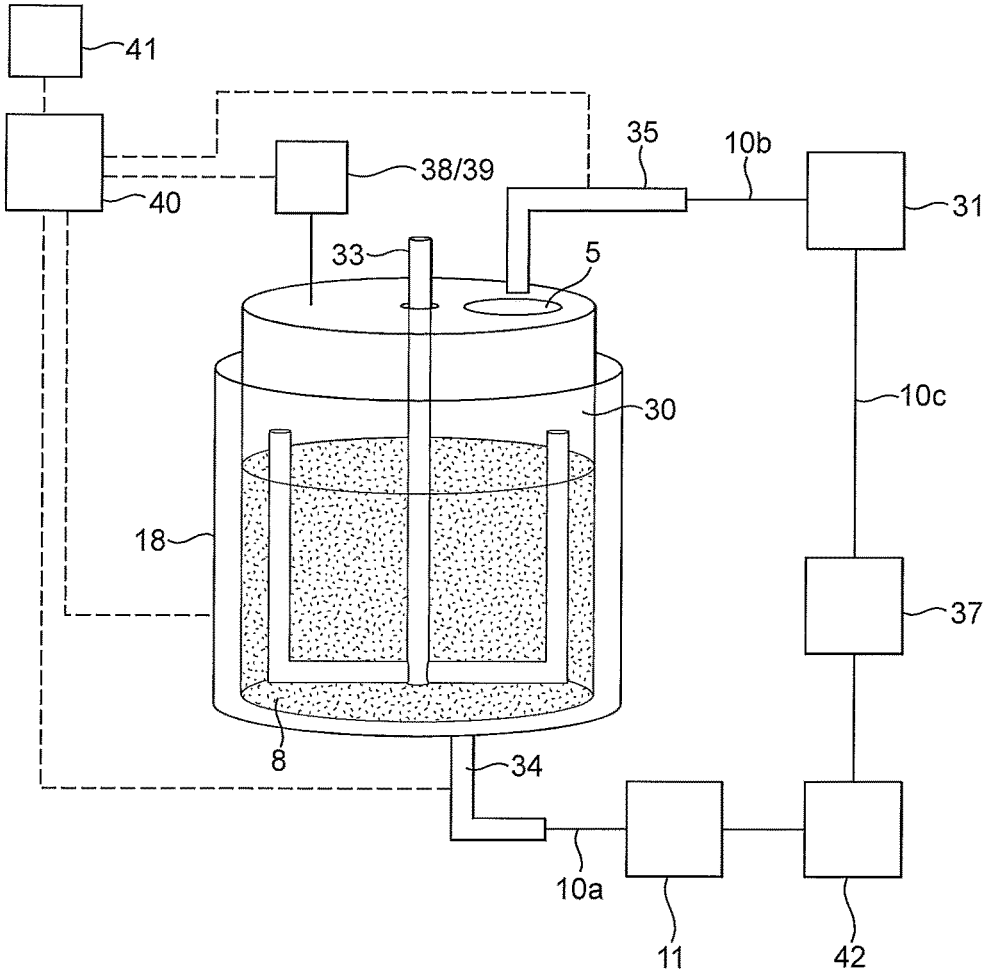
FIG. 5 is an enlarged side view of the donor product storage chamber of the embodiment shown in FIG. 4.

Similar results can be obtained using another embodiment that is shown in FIGS. 4 and 5. As can be seen from FIG. 4, the apparatus comprises a donor product storage chamber 30 and a recipient product storage chamber 31. The donor product storage chamber 30 and the recipient product storage chamber 31 may be formed from any durable material that can withstand a wide range of environmental conditions such as variations in heat, pressure and humidity. Suitable materials include, but are not limited to, metals such as steel, particularly stainless steel or any other durable metal or alloy. A plastics material could be used as long as its particular composition does not elute contaminants into recipient product.

FIG. 5 shows the donor product storage chamber 30 in more detail. The donor product storage chamber 30 is a cylindrical vessel provided with a closure such as a lid 5 to allow the donor product 8 to be inserted and removed.

The recipient product storage chamber 31 may be provided as a rotary drum, as shown in FIG. 4, rotatable about an axis of rotation 22 that may be driven by a motor 21 as illustrated in FIG. 2. The recipient product storage chamber 31 may also be provided with a closure such as a lid (not shown) to allow insertion and removal of a recipient product 2.

The donor product storage chamber 30 and the recipient product storage chamber 31 are connected together by a conduit arrangement in the form of a closed loop of pipes 10. A first pipe 10*a* extends between pump 11 and the donor product storage chamber 30. A second pipe 10*b* extends from the donor product storage chamber 30 to the recipient product storage chamber 31. A third pipe 10*c* extends between the recipient product storage chamber 31 and the pump 10. As such, fluid can circulate repeatedly between the donor product storage chamber 30 and the recipient product storage chamber 31 in a closed loop that is sealed from the atmosphere.

The pipes 10 may be formed from a durable material to withstand conditions such as high temperature, humidity and fluid flow rate, and where jointed should not include a sealant that would introduce contaminants into the fluid flow.

In the embodiment shown in FIG. 4, the pump 11 is operable to circulate the fluid through the pipes 10 and chambers 30, 31 and may comprise a peristaltic pump. However, other suitable pumps may be used. Alternative types of pump that could be used include amongst others, a vane pump, centrifugal compressor, piston pump, gear pump and liquid ring pump. The pump 11 is provided with a pump controller 32 to control the flow rate at which fluid is conveyed around the apparatus.

The donor product storage chamber 30 may be provided with an agitator to agitate the donor product 8 stored therein. For example, a stirring rod 33 may be provided to agitate the donor product 8 by a stirring action to encourage sensate release from the donor product into the fluid flow.

The storage chamber 30 includes a mesh (not shown in FIG. 4 or 5) at the bottom in the manner of mesh 15 shown in FIG. 2 to support the donor product 8 and also to allow for distributed process air flow across the base of the bed of donor product material.

Alternatively, the donor product 8 may be agitated by vibrating the donor product storage chamber 5 or the chamber may be constructed as a fluidised bed in which the flow of fluid itself agitates the donor product.

Also the recipient product 2 may be agitated and as shown in FIG. 4, the cylindrical recipient product storage chamber 31 may be rotated about its axis of rotation 20. Also an agitator such as a stirring rod (not shown) substantially similar to the stirring rod 35 may be provided to agitate the recipient product 2 thus allowing a more even distribution across the recipient product 2.

Furthermore, the recipient product 10 may be agitated by vibrating the recipient product storage chamber 10. Agitating the recipient product 2 further facilitates sensate substances obtained from the donor product 8 coming into contact with the recipient product 2.

As shown in FIGS. 4 and 5, a heat source such as a heat jacket 18 can be provided around the exterior of the donor product storage chamber 30 to heat its contents, namely the donor product 8 as well as any fluid present in the donor product storage chamber 30. The heat jacket 18 may be a resistive heating element wrapped around the donor product storage chamber 30 and provided with an external insulating layer to reduce heat losses external to the apparatus. As will be appreciated by those skilled in the art, there are alternative methods to heat the storage chamber 30, not limited to but including circulating steam or hot water in a jacket around the vessel or through a coil contained inside the vessel. The heat jacket 18 may wrap around the full circumference and also the upper and lower ends of the chamber 30 and is shown cut away to aid illustration of the donor product storage chamber 30 and its contents.

Alternatively, or in combination with the heat jacket 18, the fluid that enters the chamber 30 through the pipe 10*a* may be pre-heated to heat the contents of the donor product storage chamber 30. To this end, a heat jacket 34 may be arranged around the pipe 10*a* to pre-heat the fluid entering the chamber 30. Alternatively, the fluid maybe preheated by being passed through a suitable heat exchanger. An advantage of preheating the air is the increased heat transfer into the botanical product 8 stored within storage chamber 30.

A further heat jacket 35 may be provided around the pipe 10*b* to keep maintain the temperature of the sensate bearing fluid passing from the chamber 30 to the chamber 31 and prevent condensation prior to reaching the chamber 31.

The donor product 8 may be conditioned prior to insertion into the donor product storage chamber 30. For example, in embodiments where the donor product 8 is mint the mint may be cut or ground to a desired mean particle size. A quantity of water such as 10-50 ml for example 30 ml per kilogram of mint may be added to the mint.

Botanicals, such as coffee, juniper and anise may be frozen prior to use to retain their sensates whilst stored prior to use in the apparatus. A typical temperature range within which botanicals may be frozen to is −26° C. to 0° C. They may ground prior to freezing or afterwards. The frozen botanical may then be ground again in preparation for use in the apparatus. The grinding process produces a distribution of particle sizes and conveniently more than 50% of the particle size distribution falls within a range from 0.5 mm to 1.5 mm. This conditioning the botanical prior to use in the apparatus facilitates release of sensate substances from the donor product 8 during use of the apparatus.

As previously mentioned, fluid such as air is repeatedly circulated in a loop through the conduit arrangement 10. However, other fluids could be used, such as a gas or gaseous mixture containing a minimal levels of oxygen, to reduce the risk of spontaneous combustion e.g. of unwanted dust produced by the grinding process or tobacco dust. A suitable gas is nitrogen, but alternatives could include steam or inert gases, for example noble gases such as helium. A further advantage of using an oxygen deficient process fluid is that the sensate compounds are less likely to oxidise, thus avoiding changes to their characterising flavour or odours.

In use, fluid enters the base of the donor product storage chamber 30 through the pipe 10*a* and entrains a sensate comprising a flavourant to be imparted to the recipient product in the recipient product storage chamber 31. The flavourant containing fluid created in the chamber 30 passes into pipe 10*b* and enters the recipient product storage chamber 31 so as to impart the flavourant into the recipient product 2 as explained in more detail hereinafter.

Thereafter pipe 10*c* conveys the fluid from the recipient product storage chamber 31 through the pump 10 back into chamber 30 to complete the cycle, which may be repeated a sufficient number of times to achieve the desired level of infusion into the tobacco product. The inlet of the pipe 10*c* is disposed buried below the level of the tobacco 2 to ensure that the fluid bearing the sensate from pipe 10*b* is drawn through the tobacco product to impart the sensate into the tobacco. An inlet mesh filter 36 is provided over the inlet of pipe 10*c* to reduce ingress of tobacco into the pipe, so as to reduce the likelihood of it reaching the chamber 30.

Also a dust receptacle 37 can be located in the pipe 10*c* between the recipient product storage chamber 31 and the pump 11 to receive tobacco dust or other refuse matter. The dust receptacle may comprise for example a large volume settling tank, a cyclone, a filtration system using a filter medium, or a scrubber that removes solids from the fluid flow but permits residual sensates entrained in fluid flow to recirculate.

Filters may additionally or alternatively be provided elsewhere in the apparatus, for example where the pipe 10*b* leaves the recipient product storage chamber 30.

Various parameters, such as temperature, humidity, pressure or fluid flow rate within the apparatus may be measured using one or more measuring devices. In the embodiment shown in FIGS. 4 and 5, a thermometer or thermocouple 38 is used to measure temperature inside the donor product storage chamber 30. Other measuring devices 39 may be used to measure other parameters such as a hygrometer or other suitable measuring device may be provided to measure humidity, a pressure gauge may be provided to measure pressure and a flow meter may be provided to measure fluid flow rate within the apparatus 1.

A controller 40 may be provided to control the temperature to which the heat jacket 18 heats contents of the donor product storage chamber 30 and the level of heating provided by the heat jackets 34, 35 around the pipes 10*a*, 10*b* that lead to and from the chamber 30. The controller 40 may comprise a user interface 41 to allow a user to input a temperature value to which contents of the donor product storage chamber 5 are to be heated. It is possible to control the temperature in response to a temperature measured by the thermometer 38. For example, if the thermometer 38 measures a temperature of 100° C. a user may input an instruction into the controller 40 via the user interface 41 to reduce the temperature to 90° C. for example. The controller 40 controls the heat jacket 18 to reduce the temperature accordingly.

The controller 40 may be automated. In this case the controller may be programmed to reduce the temperature automatically when a temperature measured by the thermometer 38 rises above a predetermined value to provide a control feedback loop that maintains the temperature a present nominal value. For example, the controller 40 may control the power applied to the heat jacket 18 to maintain the temperature close to a set value of 90° C.

While FIGS. 4 and 5 show an embodiment where a temperature feedback loop may be established with respect to the donor product storage chamber 30, it should be understood that such a feedback loop may be established with respect to other parts of the apparatus 1 such as the recipient product storage chamber 31 or the individual pipes 10. For example, a heat source, thermometer and controller may be provided to the recipient product storage chamber 31.

In certain embodiments, the controller 40 may be configured to vary various other parameters (that is, in addition to or instead of temperature) in response to a measured parameter. For example, the controller may vary the temperature in response to a measured value of humidity or pressure. Alternatively, the pressure may be varied in response to a measured temperature. In general, the apparatus may provide a feedback loop where a parameter may be varied in response to a measured value of the same or different parameter.

It is to be understood that while the measurement and control of parameters have been described with respect to the donor product storage chamber 30, in other embodiments a parameter of any part of the apparatus may be controlled in response to a measurement of a parameter made elsewhere in the apparatus. For example, in some embodiments the recipient product storage chamber 31 may be provided with a heat source and controller. The contents of the recipient product storage chamber 30 may be heated to a particular temperature in response to, for example, a measured pressure value within the donor product storage chamber 31.

In use, fluid, for example air, is pumped by the pump 11 into the donor product storage chamber 30 through the duct 10*a*. The heat jacket 18 heats contents of the donor product storage chamber 30 to a predetermined temperature set by the controller 40. The temperature to which contents of the donor product storage chamber 30 is heated depends on the donor product 8 stored therein although conveniently falls within a range of 10° C.-150° C. and more particularly 20° C.-110° C. for botanicals. For example, mint may be heated to a nominal temperature of 90° C., coffee may be heated up to 40° C., clove may be heated to 110° C. As the contents of the donor product storage chamber 30 are heated to a particular temperature, certain sensate substances contained within the donor product 8 having a boiling temperature below that particular temperature become substantially volatilised.

The fluid that exits the donor product storage chamber 30 through the pipe 10*b* may be heated by the heat jacket 35, which reduces the amount of volatilised sensate substance that condenses before entering the recipient product storage chamber 31. In the embodiment shown in FIG. 5, the pipe 10*b* is shown extending vertically from the donor product storage chamber 30. This arrangement has the advantage that any substances that do condense in the pipe 10*b* are likely to fall back into the donor product storage chamber 30 where they may be re-volatilised. As such, the amount of substances that condense in the pipe 10*b* may be reduced.

A temperature differential may be established between the contents of the recipient product storage chamber 31 and the contents of the donor product storage chamber 30. In addition to providing a heat source for the donor product storage chamber 30, as shown in FIGS. 4 and 5, a heat source such as a heat jacket (not shown) may also be provided for the recipient product storage chamber 31 with an associated temperature sensor coupled to the controller 40 to maintain the temperature differential.

A substantial amount of the sensate substances conveyed into the recipient product storage chamber 31 from the donor product storage chamber 30 through the pipe 10*b* condense inside the recipient product storage chamber 31 and come into contact with the recipient product 8 stored therein. The recipient product 8 thereby becomes imparted with an organoleptic quality of the sensate substances obtained from the donor product 2.

Agitating the recipient product storage chamber 31, as described above, further facilitates contact between sensate substances obtained from the donor product 8 with the recipient product 2 within the recipient product storage chamber 31.

The fluid may be circulated repeatedly between the donor product storage chamber 30 and the recipient product storage chamber 31. Such repeated circulation may be performed as often as is necessary to impart the recipient product with a desired level of organoleptic quality derived from the donor product. For example, recirculation may be performed over a predetermined time period typically between 4-9 hours, such as between 5-7 hours for example 6 hours or the process may be continued until sensed parameters of the process indicate completion.

The apparatus 1 may be formed from such materials which facilitate a reduction in the amount of foreign substances (i.e. unwanted substances from outside the apparatus 1) entering the apparatus 1. For example, materials having a low porosity such as stainless steel or aluminium may be used to form the donor product storage chamber 30 and the recipient product storage chamber 31.

Additionally, respective closures, such as the lid 15 of the donor product storage chamber 5 and the lid (not shown) of the recipient product storage chamber 10 may be fitted with a seal to minimise ingress of foreign substances from outside, and to minimise losses of the process air containing the sensate vapours to the external atmosphere.

Regions where component parts of the apparatus 1 come into contact, for example where the donor product storage chamber 30 and pipe 10*a* come into contact, may be configured to reduce foreign substances entering the apparatus. For example, the components may be dimensioned to ensure an interference fit or a suitable non-eluting sealant may be provided.

The temperature of the contents of the donor product storage chamber 30 may be varied using the controller 40 as described above, by varying the temperature within various parts of the apparatus such as the donor product storage chamber 30. Different sensate substances of the donor product 8 stored in the donor product storage chamber 30 may become volatilised at different temperatures and by varying the temperature within the donor product storage chamber 30 from a first temperature value during a first time period to a second temperature value during a second time period may facilitate volatilisation of different sensate substances during different time periods.

For example, during a first time period P1 the donor product storage chamber 30 may be heated to a temperature T1. Sensate substances S1 of the donor product 8 having a boiling temperature below T1 become substantially volatilised and conveyed in the fluid flow under the action of the pump 11 through the pipe 10*b* and towards the recipient product storage chamber 31. Sensate substances that require a higher temperature than temperature T1 to become volatilised do not become substantially volatilised during the first time period P1.

During a second time period P2 the donor product storage chamber 30 may be heated to a temperature T2 which is greater than T1. Since T2 is greater than T1 sensate substances S1 described above continue to be volatilised. Additionally, sensate substances S2 which have a boiling temperature higher than T1 but less than T2 and which were not substantially volatilised during time period P1 become substantially volatilised during time period P2. Such sensate substances S2 may then be conveyed in the fluid flow by the pump 11 towards the recipient product storage chamber 31.

Thus the temperature of the donor product storage chamber 5 may be increased during successive time periods to achieve the volatilisation of sensate substances with successively higher boiling temperatures.

At higher temperatures the donor product 8 or sensate constituents may begin to become degraded. By gradually increasing the temperature during successive time periods any such degradation is likely to occur after sensate substances with lower boiling points have been substantially volatilised. By contrast, if the donor product 8 were exposed to a high temperature well above the boiling point of sensate substances S1 during time period P1 then the organoleptic quality of the sensate substance S1 may be affected.

Varying the temperature during successive time periods may be performed manually by, for example, manually adjusting the controller 40 through the user interface 41. Alternatively, the controller 40 may comprise a memory to store instructions and a processor so that varying the temperature over successive time periods may be automated. For example, the memory may contain instructions to heat the donor product storage chamber 30 to a temperature of approximately 30° C. for 20 minutes and then heat the donor product storage chamber 30 to a temperature of approximately 95° C. for 60 minutes.

During the above described process, fluid samples may be analysed by an analysis unit 42 such as a mass spectrometer or a gas chromatograph which provides a chromatogram that provides information regarding what substances are present in the fluid samples and in what quantity. For example, the chromatogram may indicate that particular sensate substances obtained from the donor product 8 are present in a particular amount. Additionally, the presence of any substances that were used to condition the donor product 8 prior to commencing the above described process, such as water, may also be analysed. Chromatograms may also show the presence of foreign substances inside the apparatus which might indicate the presence of a leak.

In embodiments described with respect to FIGS. 4 and 5, the analysis unit 42 is connected to the pipe 10*c* but the analysis unit 42 may be connected to either of the pipes 10*a* or 10*b*. Indeed, the analysis unit may take and analyse samples from a single point or several points along the conduit arrangement 10 or within the chambers 30,31.

Fluid samples may be obtained from the pipe 10*b* before the fluid enters into the recipient product storage chamber 31 and/or from the pipe 10*c* after the fluid exits the recipient product storage chamber 31. When obtained both before and after entry into the recipient product storage chamber 31, such samples may be compared so that information may be obtained as to what substances have been deposited inside the recipient product storage chamber 31.

Based on the results thereby obtained the temperature of parts of the apparatus such as the donor product storage chamber 30, may be varied using the controller 40. For example, if a particular sensate substance is shown in the chromatogram to be present in the fluid sample in an amount below a desired amount then the temperature may be increased to increase volatilisation of that sensate substance. Conversely, if a sensate substance is found to be present in too great an amount then the temperature of the donor product storage chamber may be reduced to decrease volatilisation of that sensate substance. In addition, the chromatogram can give an indication as to the level of completion of the process, by visualising the profile of the concentration of sensate components over the time of operation. The profiles obtained can aid the decision of when to stop the circulation of the process fluid or heating of the storage vessel, since the release of sensate materials follows a natural decay curve there is a point where further processing would yield minimal transfer of sensate components.

Two specific examples of use of the apparatus of FIGS. 4 and 5 are given below, in which a single charge of the recipient product is imparted with an organoleptic quality of a sensate substance obtained from a single charge of the donor product.

Example 1—Coffee

The recipient product chamber 31 contained shred, commercial grade tobacco 2 for use in cigarette tobacco rods.

The donor product chamber 30 contained coffee prepared by grinding Costa Rica mild coffee beans. The beans were frozen prior to use and were ground in a mill with a sieve attachment. After the ground coffee was placed in chamber 30, heating was started at 30° C. for both the heat jacket 18 pipe heater jackets 34, 35.

The agitator paddle 33 was used to stir the contents of chamber 30, initially with a small number of rotations e.g. one or two, at spaced apart time periods of typically 20 minutes which increased to three or four rotations spaced apart by approximately one hour as the process progressed. The overall infusion time was approximately 7 hours.

The heating of the chamber 30 was increased on two occasions: from 30° C. to 45° C. after 55 min and then to 55° C. after another hour.

The tobacco 2 on removal from the chamber 31 was found to have a clearly discernable coffee aroma.

Example 2—Juniper

The recipient product chamber 31 contained shred, commercial grade tobacco 2 for use in cigarette tobacco rods.

The donor product chamber 30 contained Juniper berry prepared by grinding. The berries were frozen prior to use and initially ground in a mill without a sieve attachment, were then re-frozen and ground in a mill and passed through a 4 mm sieve attachment. After the ground material was placed in chamber 30, heating was carried out at 90° C. for both the heat jacket 18 pipe heater jackets 34, 35 for a period of 6 hours.

As in Example 1, the agitator paddle 33 was used to stir the contents of chamber 30. The tobacco 2 on removal from the chamber 31 was found to have a clearly discernable coffee aroma.

In both of the examples, the tobacco may be left in the chamber 31 for a period of time after the pump 30 has been switched off, before removal from the chamber, which has been found to assist in the permeation of the flavourant into the recipient tobacco.

In a modification, the paddle 33 is designed to work as a grinder so that the grinding of the botanical can be carried out in situ within the chamber 30 with the lid 5 closed. This reduces dust formation which occurs during grinding of the botanical outside of the apparatus.

As well as varying the temperature of the donor product storage chamber 30, the humidity, fluid flow rate and/or pressure within the apparatus, as well as the duration of the process, the level of agitation of the contents of the donor product storage chamber 30 and the recipient product storage chamber 31 may be varied. Variation of such parameters may be performed without interrupting the process itself.

It will be appreciated that it would be possible to adapt or design any of the apparatus described herein to operate at either a partial vacuum or at a pressure higher than atmospheric. Certain botanicals may respond better to variation in pressure from atmospheric to enable transfer of more thermally delicate sensate components.

In order to address various issues and advance the art, the entirety of this disclosure shows by way of illustration various embodiments in which the claimed invention may be practiced and provide for superior imparting of an organoleptic quality to a recipient product using a sensate substance obtained from a donor product. The advantages and features of the disclosure are of a representative sample of embodiments only, and are not exhaustive or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for imparting an organoleptic quality to a recipient tobacco industry product using a sensate substance obtained from a donor product, the apparatus comprising:

a donor product storage chamber configured to receive a batch of donor product, a recipient tobacco industry product storage chamber configured to receive a batch of recipient tobacco industry product comprising at least one of tobacco, chewing tobacco, snus, pouched snus, filter paper, tipping paper, filtration material, smoking articles, smoking article containers and blanks for forming smoking article containers, wherein the smoking article containers are configured to contain smoking articles comprising tobacco rods the apparatus being arranged to circulate a fluid obtained from the donor product repeatedly in a closed loop through the donor product storage chamber and the recipient tobacco industry product storage chamber so that at least one sensate substance obtained from the donor product is conveyed from the donor product storage chamber into the recipient tobacco industry product storage chamber and into contact with the recipient tobacco industry product such that the at least one sensate substance condenses and is infused into or impregnates the recipient tobacco industry product.

2. The apparatus according to claim 1, further comprising a controller configured such that, in use, the batch of donor product in the donor product storage chamber is heated to a first temperature for a first time period and is then heated to a second temperature, greater than the first temperature, for a second time period, the controller comprising a processor and a memory to store instructions so that heating the batch of donor product in the donor product storage chamber to the first temperature for the first time period and then to the second temperature for the second time period can be automated, wherein the controller is configured to control a parameter of contents of the apparatus whilst the sensate substance is conveyed to the recipient tobacco industry product.

3. The apparatus according to claim 2, wherein the controller is configured to vary over time the temperature of contents of the apparatus.

4. The apparatus according to claim 2, wherein the controller is configured to maintain a temperature differential between contents of different parts of the apparatus.

5. The apparatus according to claim 2, wherein the controller is configured to be responsive to a measured value of a first parameter of the contents of the apparatus and configured to control a second parameter of the contents of the apparatus in response to said measured value of the first parameter.

6. The apparatus according to claim 5, wherein the first parameter is the same parameter as the second parameter.

7. The apparatus according to claim 5, wherein the first and second parameters are, respectively, at least one of: temperature, humidity, pressure, and fluid flow rate.

8. The apparatus according to claim 1, further comprising a heat source to heat contents of the apparatus.

9. The apparatus according to claim 8, including a heater to heat the contents of the donor product storage chamber.

10. The apparatus according to claim 8, including a heater to pre-heat the fluid entering the donor product storage chamber.

11. The apparatus according to claim 1, configured such that a single batch of recipient tobacco industry product is imparted with an organoleptic quality of a sensate substance obtained from a single batch of donor product.

12. The apparatus according to claim 1, wherein the donor product storage chamber comprises an agitator configured to agitate the batch of donor product.

13. The apparatus according to claim 1, further comprising a pump configured to circulate the fluid between and through the chambers.

14. The apparatus according to claim 1, wherein the donor product storage chamber contains a botanical.

15. The apparatus according to claim 1, and charged with the fluid which comprises air.

16. The apparatus according to claim 1, whereby at least one of the donor product storage chamber and the recipient tobacco industry product storage chamber is operable to fluidise contents thereof.

17. The apparatus according to claim 1, including a mass spectrometer configured to sample process fluids and monitor sensate constituents so as to permit control of the temperature of the donor product storage chamber.

18. A method to impart an organoleptic quality to a recipient tobacco industry product using a sensate substance obtained from a donor product, utilising apparatus according to claim 1.

19. The apparatus according to claim 1, wherein at least one of the recipient tobacco industry product storage chamber and the donor product storage chamber comprises a vibrating agitator configured to agitate a batch of product received therein.

20. The apparatus according to claim 1, wherein the tobacco comprises cut rag tobacco, tobacco in whole leaf form or laminar, shredded tobacco leaf, stem, reconstituted tobacco sheet or papers or ground tobacco.

21. An apparatus for imparting an organoleptic quality to a recipient tobacco industry product using a sensate substance obtained from a donor product, the apparatus comprising:

a donor product storage chamber configured to receive a batch of donor product;

a recipient tobacco industry product storage chamber configured to receive a batch of recipient tobacco industry product comprising at least one of tobacco, chewing tobacco, snus, pouched snus, filter paper, tipping paper, filtration material, smoking articles, smoking article containers and blanks for forming smoking article containers, wherein the smoking article containers are configured to contain smoking articles comprising tobacco rods;

a heater configured to heat the donor product storage chamber; and a controller configured to control the heater such that, in use, the heater heats the donor product storage chamber to a first temperature for a first time period to release a first sensate substance from the batch of donor product, and then heats the donor product storage chamber to a second temperature, greater than the first temperature, for a second time period to release a second sensate substance from the batch of donor product, the controller comprising a processor and a memory to store instructions so that heating the batch of donor product in the donor product storage chamber to the first temperature for the first time period and then to the second temperature for the second time period can be automated, the apparatus configured to circulate a fluid repeatedly in a closed loop through the donor product storage chamber and the recipient tobacco industry product storage chamber so that the first sensate substance obtained from the batch of donor product is conveyed from the donor product storage chamber into the recipient tobacco industry product storage chamber and into contact with the batch of recipient tobacco industry product such that the first sensate substance condenses and is infused into or impregnates the recipient tobacco industry product, and then the second sensate substance obtained from the batch of donor product is conveyed from the donor product storage chamber into the recipient tobacco industry product storage chamber and into contact with the batch of recipient tobacco industry product such that the second sensate substance condenses and is infused into or impregnates the recipient tobacco industry product, and wherein the donor product storage chamber includes a vibrating agitator configured to agitate the batch of donor product received therein to facilitate the conveyance of the first sensate substance and the second sensate substance from the batch of donor product to the circulating fluid.

22. An apparatus for imparting an organoleptic quality to a recipient tobacco industry product using a sensate substance obtained from a donor product, the apparatus comprising:

a donor product storage chamber configured to receive a batch of donor product, and a recipient tobacco industry product storage chamber comprising an agitator and configured to receive a batch of recipient tobacco industry product comprising at least one of tobacco, chewing tobacco, snus, pouched snus, filter paper, tipping paper, filtration material, smoking articles, smoking article containers and blanks for forming smoking article containers, wherein the smoking article containers are configured to contain smoking articles comprising tobacco rods, the agitator configured to agitate the batch of recipient product; and a controller configured such that, in use, the batch of donor product in the donor product storage chamber is heated to a first temperature for a first time period and is then heated to a second temperature, greater than the first temperature, for a second time period, the controller comprising a processor and a memory to store instructions so that heating the batch of donor product in the donor product storage chamber to the first temperature for the first time period and then to the second temperature for the second time period can be automated, the apparatus configured to circulate a fluid repeatedly in a closed loop through the donor product storage chamber and the recipient tobacco industry product storage chamber so that at least one sensate substance from the batch of donor product is conveyed from the donor product storage chamber into the recipient tobacco industry product storage chamber and into contact with the batch of recipient tobacco industry product such that the at least one sensate substance condenses and is infused into or impregnates the recipient tobacco industry product, the agitator configured to facilitate even distribution of the at least one sensate substance across the batch of recipient tobacco industry product.

* * * * *